United States Patent [19]

Bell, Jr. et al.

[11] 4,183,401

[45] Jan. 15, 1980

[54] COMBINATION TUBE SHEET AND BAFFLE

[75] Inventors: William W. Bell, Jr., Marcellus; Rudy C. Bussjager, Syracuse, both of N.Y.

[73] Assignee: Carrier Corporation, Syracuse, N.Y.

[21] Appl. No.: 837,122

[22] Filed: Sep. 28, 1977

[51] Int. Cl.[2] ..... B22C 00/00; B22C 13/02

[52] U.S. Cl. ..... 165/159; 165/162

[58] Field of Search ..... 165/160, 159, 161, 162, 165/80, 78

[56] References Cited

U.S. PATENT DOCUMENTS

| | | | |
|---|---|---|---|
| 1,803,034 | 4/1931 | Potter | 165/160 |
| 1,822,698 | 8/1931 | How | 165/160 |
| 2,200,787 | 5/1940 | Coy | 165/160 |
| 2,335,479 | 11/1943 | Berkeley | 165/160 |
| 2,417,661 | 3/1947 | Rosales | 165/162 |
| 2,577,832 | 12/1951 | Weiks | 165/160 |
| 2,811,337 | 10/1957 | Andersen | 165/159 |
| 2,873,098 | 2/1959 | Morgan | 165/159 |

*Primary Examiner*—Charles J. Myhre
*Assistant Examiner*—Carl Stuart Miller
*Attorney, Agent, or Firm*—J. Raymond Curtin; Robert P. Hayter

[57] ABSTRACT

Apparatus comprising a combination tube support for supporting tubes within a shell and tube type heat exchanger and baffle for directing fluid flow within the heat exchanger. A baffle lip is mounted on a baffle body to provide a seal with the interior surface of the heat exchanger shell. A foot having support surfaces of varying heights is used to support the baffle body to prevent the weight of the baffle body and the tubes contained therein as well as other forces from collapsing a portion of the baffle lip.

8 Claims, 6 Drawing Figures

COMBINATION TUBE SHEET AND BAFFLE

BACKGROUND OF THE INVENTION

1. Field of the Invention

This invention relates to a tube support and baffle combination for use in a heat exchanger. More particularly this invention may be used to provide a combination tube support and fluid type baffle within a shell and tube type heat exchanger.

2. Description of the Prior Art

In a conventional tube and shell type chiller, refrigerant carrying tubes are mounted within a shell in heat exchange relationship with a fluid to be cooled passing through the shell. This fluid to be cooled is usually water, brine, ethylene glycol or some similar fluid used to transfer heat between the chiller and the area to be cooled. The chiller is typically the evaporator of the refrigeration system wherein liquid refrigerant is converted to a gaseous refrigerant absorbing heat from the fluid to be cooled in the process.

The tubes within the shell and tube type heat exchanger are typically secured by tube sheets in a spaced parallel arrangement so that the fluid to be cooled can be circulated among and around the tubes. In addition thereto baffles are inserted into the heat exchanger to direct the fluid to be cooled in a tortuous path through the heat exchanger. By circulating the fluid to be cooled through a tortuous path the fluid water side heat transfer coefficient is increased and the overall amount of heat transfer from the fluid to the refrigerant is likewise increased.

The problem with conventional baffles is that part of the fluid to be cooled bypasses the baffle between the baffle and the shell thereby short-circuiting the heat exchanger and simultaneously reducing the heat transfer coefficient since the fluid velocity through the tortuous path is decreased and the mean temperature difference is decreased. This by-pass effect is especially pronounced since the shell of the typical shell and tube type heat exchanger is a segment of a commercially available pipe. This pipe is made to a large tolerance range and consequently baffle fit is often sloppy depending upon where the internal diameter of the pipe falls within the tolerance range.

This short-circuit effect has not previously been significant since in a conventional water chiller the heat transfer rate from the refrigerant to the tube was the limiting heat transfer factor in the overall performance of the heat exchanger. However, with the enhanced heat transfer surfaces being developed for tubes such as internal finning, the heat transfer rate is now controlled by heat transfer factors from the tubes to the water. Consequently, the short-circuiting of water through the heat exchanger results in a decrease in the chiller heat transfer rate and efficiency.

Typical of the baffles presently being used in shell and tube type heat exchangers are those shown in U.S. Pat. No. 3,656,588 entitled "Self Positioning Baffle for Shell and Tube Heat Exchangers" and U.S. Pat. No. 3,958,630 entitled "Heat Exchanger Baffle Arrangement". In neither case is the problem of baffle bypass addressed or resolved.

SUMMARY OF THE INVENTION

It is an object of the present invention to provide a combination tube support and baffle for use in a shell and tube type heat exchanger.

It is another object of the present invention to provide a baffle for use in a shell and tube type heat exchanger which forms a fluid-tight seal with the interior surface of the shell.

It is a further object of the present invention to provide a baffle and tube support which is easy to assemble, economical to manufacture, and which may be utilized within a shell and tube type heat exchanger where the shell is constructed from a commercially available pipe having an inside diameter within a specific tolerance range.

It is a yet further object of the present invention to provide a baffle with adjustable height means which is capable of forming a tight seal with the interior surface of the shell and tube type heat exchanger notwithstanding the inside diameter of the shell varies within a predetermined tolerance range.

Other objects will be apparent from the description to follow and the appended claims.

The present invention is a combination tube support and baffle for use in the heat exchanger. A baffle body having spaced holes for retaining tubes has mounted thereto and extending beyond the perimeter thereof a baffle lip for forming a tight seal with the interior surface of the shell of the heat exchanger. A foot which is mounted to the baffle body in a foot opening supports a portion of the weight of the baffle body and the tubes to prevent the baffle lip from being completely collapsed.

DESCRIPTION OF THE PREFERRED EMBODIMENT

The embodiment of the invention as described below is adapted for use in a shell and tube type water chiller, although it is to be understood the invention finds like applicability in other forms of heat exchanger units. The water chiller described below includes a fluid to be cooled, namely water and includes a flow path for a refrigerant for absorbing heat from the water, said flow path being through the various tubes and headers contained therein.

Figure 1:
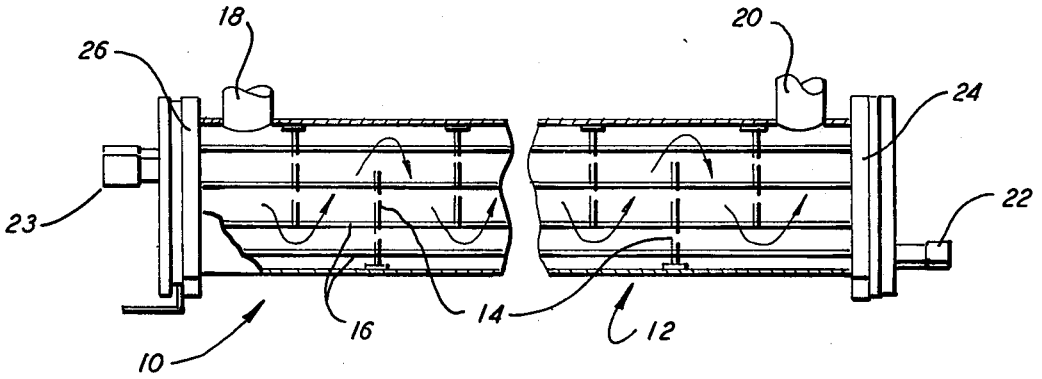
FIG. 1 is a cutaway side elevational view, partly in section, of a typical shell and tube type heat exchanger or chiller.

Referring to the drawings FIG. 1 is a view of a typical water chiller. The water chiller is comprised of a shell and tube type heat exchanger having a refrigerant flow circuit and a water flow circuit. Shell 12 is mounted with outlet header 26 and inlet header 24 to form a fluid tight compartment. Water enters within shell 12 through water inlet 18 and then flows from left to right through the water chiller and exits through water outlet 20. Refrigerant enters the chiller through refrigerant inlet 22 and then proceeds through the various tubes 16 and eventually is discharged through refrigerant outlet 23. Outlet header 26 and inlet header 24 are divided into compartments to determine in which direction and through which flow path the refrigerant will travel. The refrigerant may travel back and forth from the inlet header to the outlet header or it may make a single path through the chiller and exit at the opposite side from where it enters. Tubes 16 are shown in FIG. 1 merely to indicate that the chiller contains tubes. It is to be understood that the typical chiller contains a myriad of tubes and these are all not shown for the sake of clarity of the drawing.

Also seen in FIG. 1 are baffles 14. These baffles are so arranged that the water while traveling from water inlet 18 to water outlet 20 must follow a tortuous path from left to right in the water chiller. Arrows drawn on the diagram indicate the direction of flow of the water around the plurality of baffles. As can be further seen from FIG. 1 baffles are alternately mounted so that there is space for the water to flow around the end of the baffle at the bottom of the chiller and at the top of the chiller. The number of baffles and location of baffles being a design expedient for each shell and tube type heat exchanger. A foot is also shown for each baffle.

Figure 2:
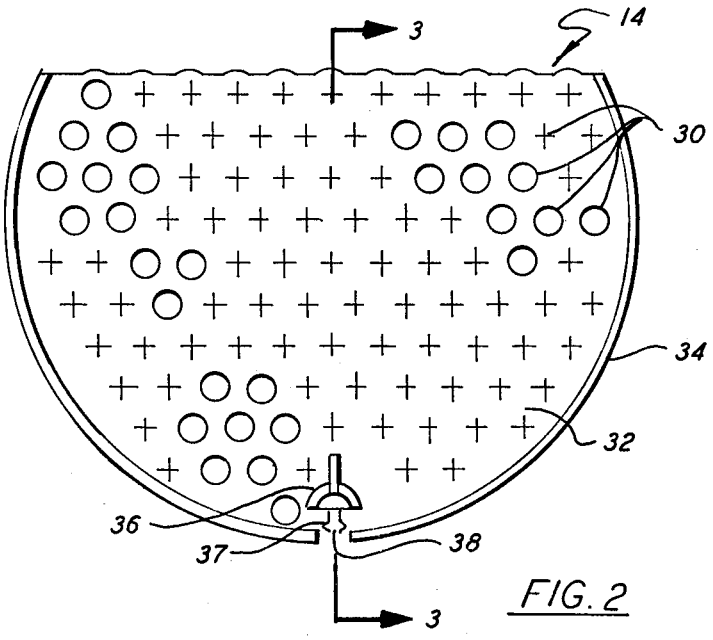
FIG. 2 is a side elevational view of a combination tube support and baffle.
Figure 3:
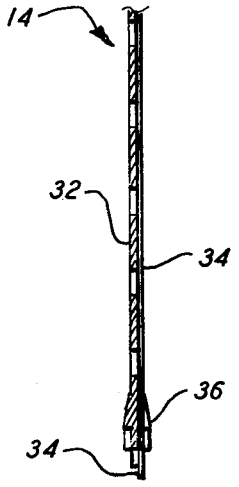
FIG. 3 is a cross-sectional end view, in section, of the combination tube support and baffle taken at line III—III in FIG. 2.

FIG. 2 depicts an end view of baffle 14, a plurality of which are shown in FIG. 1. Baffles 14 may conveniently be made of plastic or a similar flexible material. Baffle body 32 in the shape of a truncated disc provides a supporting surface for the various refrigerant carrying tubes 16. Tube retaining holes 30 are formed within baffle body 32 so that tube 16 may be inserted into the holes and thereby secured in position. It will be noted in FIG. 2 that the tubes inserted in the various holes are held in a parallel spaced relation. Baffle lip 34 which extends from baffle body 32 is relatively thin as compared to baffle body 32 and is capable of being displaced when the baffle is inserted into the heat exchanger. Also shown in FIG. 2 is baffle support 36 which is an abutment projecting from the baffle surface for transferring some of the forces resulting in the baffle as a result of the weight of the baffle and the tubes therein to foot 40. Foot (shown in FIGS. 4 and 5) accommodating notch 38 is located just below baffle support 36 so that foot 40 may be inserted therein. Notch 38 has foot locking recess 37 on either side thereof, foot locking recess 37 is sized so that foot locking projection 45 may be inserted therein.

Figure 4:
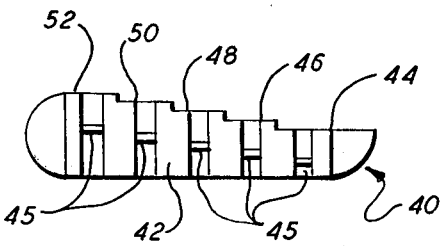
FIG. 4 is an elevational view of the foot.
Figure 5:
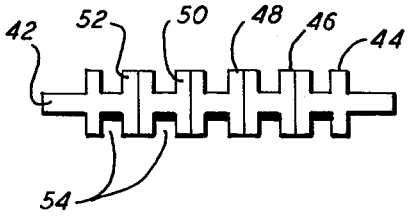
FIG. 5 is a plan view of the foot.

In FIGS. 4 and 5 it can be seen that foot 40 has a series of foot support surfaces at varying heights. First foot support surface 44, second foot support surface 46, third foot support surface 48, fourth foot support surface 50, and fifth foot support surface 52 are all arranged along the length of foot 40. Foot locking projections 45 are shown in FIG. 4 within each baffle body slot 54. Baffle body slots 54 are so designed that baffle body 32 may be slid therein and simultaneously baffle support 36 will contact the appropriate foot support surface.

During assembly of the shell and tube type heat exchanger one of the first steps is to determine the inside diameter of the shell being utilized. Often commercially available pipe is purchased for use as the shell, said pipe having tolerances which vary considerably. The outside diameter of the baffle body is known and consequently by comparing that diameter with the inside diameter of the shell it can be determined which height foot support surface should be selected to properly locate the baffle within the shell.

Baffle lip 34 is so designed that when the baffle is slid into the shell the lip will be displaced since its outside diameter is larger than the inside diameter of the shell thereby creating a tight seal between the baffle and the shell. If the baffle is not supported the weight of the baffle and tubes therein will force the baffle to the bottom of the shell and consequently collapse the baffle lip at the bottom thereby preventing a tight seal from being formed. The use of foot 40 within notch 38 assures that a portion of the force generated by the weight of the baffle and the tubes is taken by the foot through the baffle support and transferred directly to the interior surface of the shell. With the foot in position baffle lip 34 should be displaced evenly about its circumference forming a tight seal with the interior surface of the shell.

Once a tight seal is formed by the baffle with the interior surface of the shell, water being circulated through the tortuous path of the chiller is then forced to complete the entire path and is not allowed to short-circuit at any point. Consequently the overall heat transfer coefficient from the tubes to the water is increased as a result of the increased velocity of the water flowing through the heat exchanger and as a result of the water making more passes across each tube.

The baffle and the foot may both be molded from a suitable resilient plastic such as polypropylene with the baffle lip 34 appearing as "flash".

The above described preferred embodiment of the invention discloses an economical and efficient method of providing tightly sealed baffles within a shell and tube type heat exchanger. Since these baffles now require the water to be chilled to follow the designed tortuous path the overall efficiency of the chiller is increased. Specifically with the use of enhanced heat transfer internally finned tubes the overall efficiency of the chiller which is determined as a function of the water side heat transfer rate is increased.

The baffles 14 may be secured within the heat exchanger by the forces created by displacing the baffle lip 34 in relation to the interior surface of the shell and further certain tubes may be pre-selected to be crimped on either side of baffle 14. When the tube is crimped part of the tube is expanded beyond the diameter at retaining hole 30 thereby securing the baffle between the crimped areas of the tube. Upon assembly the tubes are inserted within the various baffles outside of the shell and then the whole assembly of tubes and baffles is inserted into the shell forming the various seals between the baffle and the shell in the process.

Figure 6:
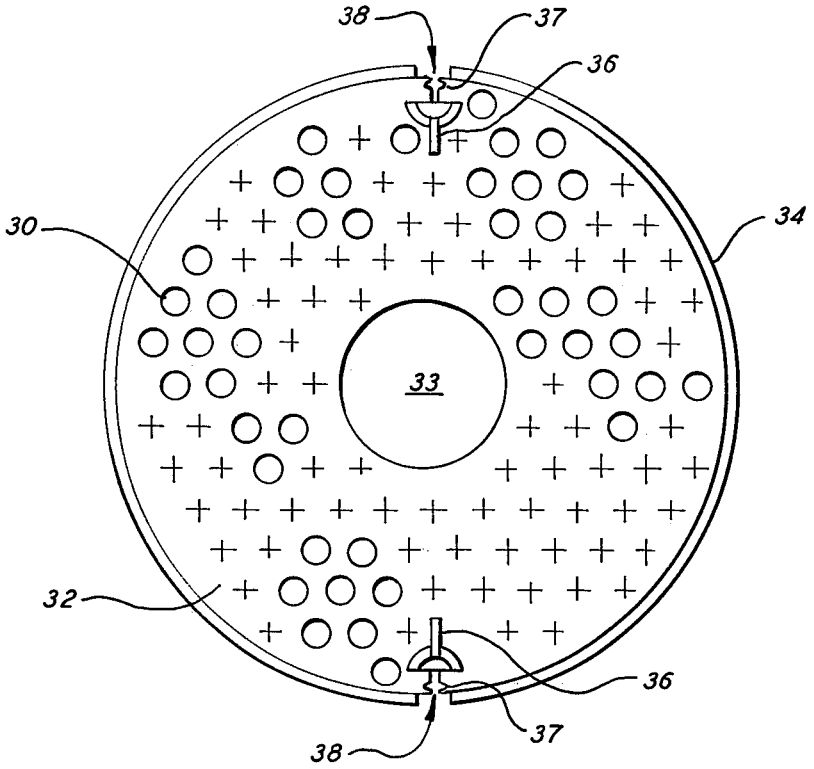
FIG. 6 is a side elevational view of a separate embodiment of a combination tube support and baffle.

Another embodiment of this invention is depicted in FIG. 6. Some shell and tube heat exchangers utilize "disc and donut" baffles which require the fluid to flow thru the center of one baffle and around the edges of the next baffle. FIG. 6 depicts the "donut" baffle thru which the fluid must flow. Baffle body 32 is annular in shape with opening 33 for the fluid to pass. The tubes are mounted in retaining holes 30 and a baffle support 36 is provided at the top and bottom of the baffle such that a foot may be inserted at both ends. Notches 38 and foot locking recesses 37 are also provided.

When a shell and tube heat exchanger using "disc and donut" baffles is assembled the "donut" baffle is secured to the tubes to hold them in place and the "disc" baffle is mounted to block the flow of the fluid to be cooled from the adjacent opening 33 in the baffle body. Of course the "disc" and "donut" baffles are alternated along the length of the heat exchanger.

In both embodiments forces other than gravity may be asserted on the baffles. It is possible for the tubes to "float" within the heat exchanger since they are immersed within the cooling fluid. Both these baffle arrangements are capable of withstanding an upward force without collapsing the baffle lip.

The invention has been described in detail with particular reference to a preferred embodiment thereof, but it will be understood that variations and modifications can be effected within the spirit and the scope of the invention.

We claim:

1. In a heat exchanger for transferring heat from a first fluid to a second fluid having a shell for containing the flow of the first fluid and having mounted within the shell tubes for containing the flow of the second fluid, a combination tube support for securing the tubes and baffle for directing the flow of the first fluid which comprises:

a baffle body having tube retaining holes in which the tubes are mounted;

a resilient baffle lip mounted to the baffle body, said lip extending from the perimeter of the baffle body to the inside surface of the shell to form a relatively fluid tight seal therebetween; and means for preventing the complete collapse of a portion of the baffle lip, said means including a foot accommodating notch in the baffle and a foot having a plurality of support surfaces at varying heights to fit within the notch and against the inside surface of the shell to support the baffle and the tubes at varying heights within the shell.

2. The apparatus as set forth in claim 1 and further including means for locking the foot to the baffle.

3. The apparatus as set forth in claim 2 wherein the locking means includes a foot locking projection on the foot which upon assembly is engaged with a foot locking recess formed as a part of the notch in the baffle thereby securing the foot to the baffle.

4. The apparatus as set forth in claim 11 wherein the sides of the tube and shell heat exchanger are crimped on either side of the combination tube sheet and baffle to secure the tube sheet and baffle in place, the crimped tubes having a greater cross-sectional dimension than the inside diameter of the tube retaining holes in the baffle.

5. In a heat exchanger for transferring heat from a first fluid to a second fluid having a shell for containing the flow of the first fluid and having mounted within the shell tubes for containing the flow of the second fluid, a combination tube support for securing the tubes and baffle for directing the flow of the first fluid which comprises:

a baffle body having an outside diameter less than the inside diameter of the shell and having tube retaining holes in which the tubes are mounted;

a resilient baffle lip substantially thinner than the baffle body and mounted to the baffle body, said lip having a greater outside diameter than the inside diameter of the shell such that the lip is partially displaced upon insertion into the shell and extends from the perimeter of the baffle body to the inside surface of the shell to form a relatively fluid tight seal therebetween; and means for supporting the baffle body and tubes contained therein to protect the baffle lip from receiving all of the load transmitted through the baffle body including a foot accomodating notch in the baffle, and a foot adapted to fit within the notch and against the inside surface of the shell to support part of the weight of the baffle and the tube secured therein whereby complete collapse of a portion of the baffle lip is prevented to maintain the seal between the baffle body and the shell.

6. The apparatus as set forth in claim 5 wherein the shell is cylindrical in configuration, wherein the baffle is in the shape of a truncated disk and wherein the baffle lip is an integral part of the baffle body being substantially thinner in thickness than the baffle body.

7. The apparatus as set forth in claim 6 wherein the shell may be of varying inside diameters within a predetermined tolerance range and wherein the baffle lip is of sufficient length to form a tight seal with the interior surface of the shell not-withstanding the actual inside diameter of the shell within said tolerance range.

8. A combination tube support for securing tubes and baffle for directing fluid flow which comprises:

a baffle body having a plurality of tube retaining holes and a foot accommodating notch;

a baffle lip mounted to the baffle body, said lip extending beyond the periphery of the baffle body and being resilient so that it may be displaced to form a fluid tight seal; and a foot having a plurality of foot support surfaces at varying foot heights, said foot being inserted within the notch so that the weight of the baffle and any tubes therein may be partially supported by the foot, the foot support surface selected for insertion into the notch being dependent on the height at which it is desired to support the baffle body.

* * * * *